US010330310B2

(12) United States Patent
Torkildson et al.

(10) Patent No.: US 10,330,310 B2
(45) Date of Patent: Jun. 25, 2019

(54) MODULAR HEAT RECOVERY STEAM GENERATOR CONSTRUCTION

(71) Applicant: Siemens Aktiengesellschaft, München (DE)

(72) Inventors: Steve V. Torkildson, Greer, SC (US); Marinus J. Van der Weiden, Greenville, SC (US)

(73) Assignee: SIEMENS HEAT TRANSFER TECHNOLOGY B.V., Zoeterwoude (NL)

( * ) Notice: Subject to any disclaimer, the term of this patent is extended or adjusted under 35 U.S.C. 154(b) by 206 days.

(21) Appl. No.: 15/304,908

(22) PCT Filed: May 22, 2015

(86) PCT No.: PCT/US2015/032115

§ 371 (c)(1),
(2) Date: Oct. 18, 2016

(87) PCT Pub. No.: WO2015/191266

PCT Pub. Date: Dec. 17, 2015

(65) Prior Publication Data

US 2017/0175998 A1 Jun. 22, 2017

Related U.S. Application Data

(60) Provisional application No. 62/010,102, filed on Jun. 10, 2014.

(51) Int. Cl.

| | |
|---|---|
| ***F22B 37/00*** | (2006.01) |
| ***F22B 37/24*** | (2006.01) |
| ***F22B 37/66*** | (2006.01) |

(52) U.S. Cl.

CPC ..... *F22B 37/244* (2013.01); *F22B 37/001* (2013.01); *F22B 37/66* (2013.01)

(58) Field of Classification Search

CPC ..... B66C 1/64; B66C 1/66; F22B 1/08; F22B 1/18; F22B 1/1807; F22B 1/1815;

(Continued)

(56) References Cited

U.S. PATENT DOCUMENTS

| | | | |
|---|---|---|---|
| 4,685,426 | A | 8/1987 | Kidaloski et al. |
| 5,339,891 | A | 8/1994 | Kidaloski et al. |

(Continued)

FOREIGN PATENT DOCUMENTS

| | | | |
|---|---|---|---|
| CN | 102080818 | A | 6/2011 |
| CN | 102393003 | A | 3/2012 |

(Continued)

OTHER PUBLICATIONS

PCT International Search Report and Written Opinion dated Oct. 14, 2015 corresponding to PCT Application PCT/US2015/032115 filed May 22, 2015. (11 pages).

*Primary Examiner* — Jason L Vaughan
*Assistant Examiner* — Amanda Kreiling

(57) ABSTRACT

A method for installing a heat recovery steam generator (1) with a plurality of pre-assembled modules (10) includes arranging a pre-assembled module (10) at an installation site. The pre-assembled module (10) includes a functional unit of the heat recovery steam generator (1) housed in a casing structure (12). The casing structure (12) includes a top casing (12*a*), a bottom casing (12*b*) and a side casing (12*c*). An open side (15) is defined opposite to the side casing (12*c*). The module (10) is arranged horizontally at the installation site with the open side (15) facing downward and the side casing (12*c*) facing upward. The method includes attaching a structural steel (13) to the side casing (12*c*) in a horizontal position without lifting the module (10). The module (10) with the attached structural steel (13) is lifted to a vertical position and secured to a foundation (60). Also described is a method for pre-assembling the (Continued)

module (10) and a method for transporting the pre-assembled module (10) to the installation site.

11 Claims, 6 Drawing Sheets

(58) Field of Classification Search
CPC ..... F22B 37/00; F22B 37/001; F22B 37/007; F22B 37/20; F22B 37/201–37/208; F22B 37/24; F22B 37/242; F22B 37/244; F22B 37/36; F22B 37/365; F22B 37/40; F22B 37/64–37/68; F22B 31/02; F22B 37/003; F22B 37/005; F22B 37/202; F22B 37/205; F22B 37/207; F22B 37/225; F28F 9/00; F28F 9/001; F28F 9/013; F28F 9/0131; Y10T 29/4935–29/49393; Y10T 29/49826; Y10T 29/49904; Y10T 29/49352; Y10T 29/49357; Y10T 29/49359; Y10T 29/49948; B23P 15/26
USPC ..... 29/428, 469, 890.03–890.054; 122/7 R–7 D, 114, 208, 220–224, 494, 122/510; 165/67, 68, 144, 145, 157–163; 294/67.1, 81.5
See application file for complete search history.

(56) References Cited

U.S. PATENT DOCUMENTS

| | | | | |
|---|---|---|---|---|
| 5,370,239 | A | 12/1994 | Kidaloski et al. | |
| 2006/0175040 | A1* | 8/2006 | Waseda ..... | F28F 9/013 165/67 |
| 2007/0119388 | A1 | 5/2007 | Waseda et al. | |

FOREIGN PATENT DOCUMENTS

| | | | |
|---|---|---|---|
| CN | 103383104 | A | 11/2013 |
| GB | 2131153 | A | 6/1984 |
| JP | 2005042960 | A | 2/2005 |
| KR | 20120117748 | A | 10/2012 |
| WO | 2005012791 | A1 | 2/2005 |

* cited by examiner

MODULAR HEAT RECOVERY STEAM GENERATOR CONSTRUCTION

CROSS REFERENCE TO RELATED APPLICATIONS

This application claims priority to the U.S. provisional application No. 62/010,102 filed Jun. 10, 2014, which is incorporated by reference herein in its entirety.

BACKGROUND

1. Field

The present invention relates to heat recovery steam generators. Specific embodiments relate to methods for pre-assembling, transportation and installation of modules of a heat recovery steam generator.

2. Description of the Related Art

A heat recovery steam generator or HRSG is an energy recovery heat exchanger that recovers heat from a hot gas stream. An HRSG produces steam that can be used in a process (cogeneration) or used to drive a steam turbine (combined cycle).

For example, in a combined cycle power generation, the exhaust gas from a combustion turbine becomes the heat source for the Rankine cycle portion of the combined cycle. An HRSG disposed downstream of the combustion turbine exhaust recovers the waste heat available in the combustion turbine exhaust gas. The recovered heat is used to generate steam at high pressure and high temperature, and the steam is then used to generate power in the steam turbine/generator.

The HRSG is basically a heat exchanger composed of a series of functional units, namely, economizers (preheaters), evaporators, reheaters, and superheaters. The functional units comprise heat exchanger tubes disposed in a flow path of the exhaust gas from the combustion turbine. The heat exchanger tubes carry a medium comprising water and/or steam to which heat from the exhaust gas is transferred, to produce steam at high temperature and pressure.

In a modular HRSG construction, the various functional units may be constructed as separate modules. The modules may be pre-fabricated and transported to an installation site where they are installed. In a modular HRSG construction, the on-field installation cost may be reduced by providing a higher degree of pre-fabrication. However, shipping costs associated with transportation of pre-fabricated modules increases with higher degree of pre-fabrication.

A modular HRSG construction typically results in a compromise between the on-field installation cost and shipping cost, as a result of which both of these costs cannot be simultaneously contained. For example, current approaches make it possible either to achieve a lower on-field installation cost by providing a high degree of prefabrication, but with the result of correspondingly high shipping costs, or to alternately achieve a lower shipping cost by providing a lower degree of fabrication, but with the result of high on-field installation cost.

SUMMARY

An object of the invention is to provide an improved heat recovery steam generator construction.

A further object of the invention is to provide improved techniques for pre-assembling, transportation and installing a module of a heat recovery steam generator.

The above objects are achieved by the features of the independent claims.

According to one aspect, a method is provided for installing a heat recovery steam generator that includes a plurality of pre-assembled modules. The method includes arranging a pre-assembled module at an installation site. The pre-assembled module includes a functional unit of the heat recovery steam generator housed in a casing structure. The casing structure includes a top casing, a bottom casing and a side casing. An open side is defined opposite to the side casing. As per the method, the module is arranged horizontally at the installation site with the open side facing downward and the side casing facing upward. The method further includes attaching an exterior structural steel component to the side casing in a horizontal position without lifting the module. The module with the attached structural steel component is then lifted to a vertical position and secured to a foundation.

The proposed method provides reduced installation cost and improved safety during installation.

During installation, the exterior structural steel is to be attached to the side casing of the module. In the state of the art installation method, the module was arranged at the installation site with its open side facing upward and the side casing facing downward. In this case, the exterior structural steel component was first lifted in a vertical position and guy-wired, which obstructed accessibility and posed a potential safety hazard. The module was lifted to a vertical position and then connected to the vertically arranged exterior structural steel component, typically by bolting or welding to the side casing at different elevations, which again posed potential safety hazards.

In contrast, as per the proposed method, arranging the pre-assembled module at the installation site with the open side facing downward and the side casing facing upward makes it possible to attach the exterior structural steel component to the side casing while the module is still horizontal, without having to lift the module. This approach reduces the installation efforts and costs as the exterior structural steel is much lighter than the pre-assembled module and is much easier to maneuver. Furthermore, this approach improves the safety of the installation procedure by eliminating the need to work at elevation to connect the module to the exterior structural steel component.

According to another aspect, a method is provided for pre-assembling a module of a heat recovery steam generator for subsequent transportation to an installation site. The method includes building a functional unit of the heat recovery steam generator. The functional unit comprises a plurality of heat exchange tubes configured for carrying a fluid medium comprising water or steam or a mixture thereof. The method further involves building a casing structure for housing the functional unit. The casing structure defines a portion of a flow conduit for a hot gas and comprises a top casing, a bottom casing and a side casing, whereby an open side is defined opposite to the side casing. As per the proposed method, the casing structure is built with the open side facing downward and the side casing facing upward.

The proposed method makes it possible to attach the exterior structural steel component to the module in a horizontal position at installation, without lifting the module. As mentioned above, this feature improves the safety of the installation by eliminating the need to work at elevation to connect the module to the exterior structural steel component.

According to yet another aspect, a method is provided for transporting a pre-assembled module of a heat recovery steam from a pre-assembly site to an installation site. The method includes loading the pre-assembled module into a transportation container at the pre-assembly site. The pre-assembled module comprises a functional unit of the heat recovery steam generator housed in a casing structure. The casing structure comprises a top casing, a bottom casing and a side casing, whereby an open side is defined opposite to the side casing. As per the method, the pre-assembled module is loaded in a horizontal position in the container with the open side facing downward and the side casing facing upward. The method involves transporting the container with the loaded pre-assembled module to the installation site. As per the method, the pre-assembled module is unloaded at the installation site, such that the unloaded the pre-assembled module is disposed at the installation site in a horizontal position with the open side facing downward and the side casing facing upward.

The above-described method provides reduced transportation costs and improved safety during transportation.

By transporting the pre-assembled module with the open side facing downward and the side casing facing upward, it is ensured that the center of gravity of the module being transported is lowered in comparison to the state of the art where the modules are transported with the open side facing upward and the side casing facing downward. The explanation for this technical effect lies in the fact that the side casing with internal insulation has lower mass density than the heat exchanger tubes. In the proposed method, the side casing with internal insulation occupies a top portion of the module being transported while the heat exchanger tubes occupy a bottom portion, thereby lowering the center of gravity of the module being.

Furthermore, in the proposed method for transportation, shipping dimensions are smaller than with a pre-assembled module with the exterior structural steel attached.

According to yet another aspect, a heat recovery steam generator is provided. The heat recovery steam generator includes a plurality of modules connected in series. Each module comprises a functional unit of the heat recovery steam generator. In the proposed heat recovery steam generator, at least one of the modules is pre-assembled and/or installed by the above described methods.

The heat recovery steam generator described in the illustrated embodiments has a simpler construction with respect to the state of the art.

BRIEF DESCRIPTION OF THE DRAWINGS

The invention is shown in more detail by help of figures. The figures show preferred configurations and do not limit the scope of the invention.

DETAILED DESCRIPTION

Figure 1:
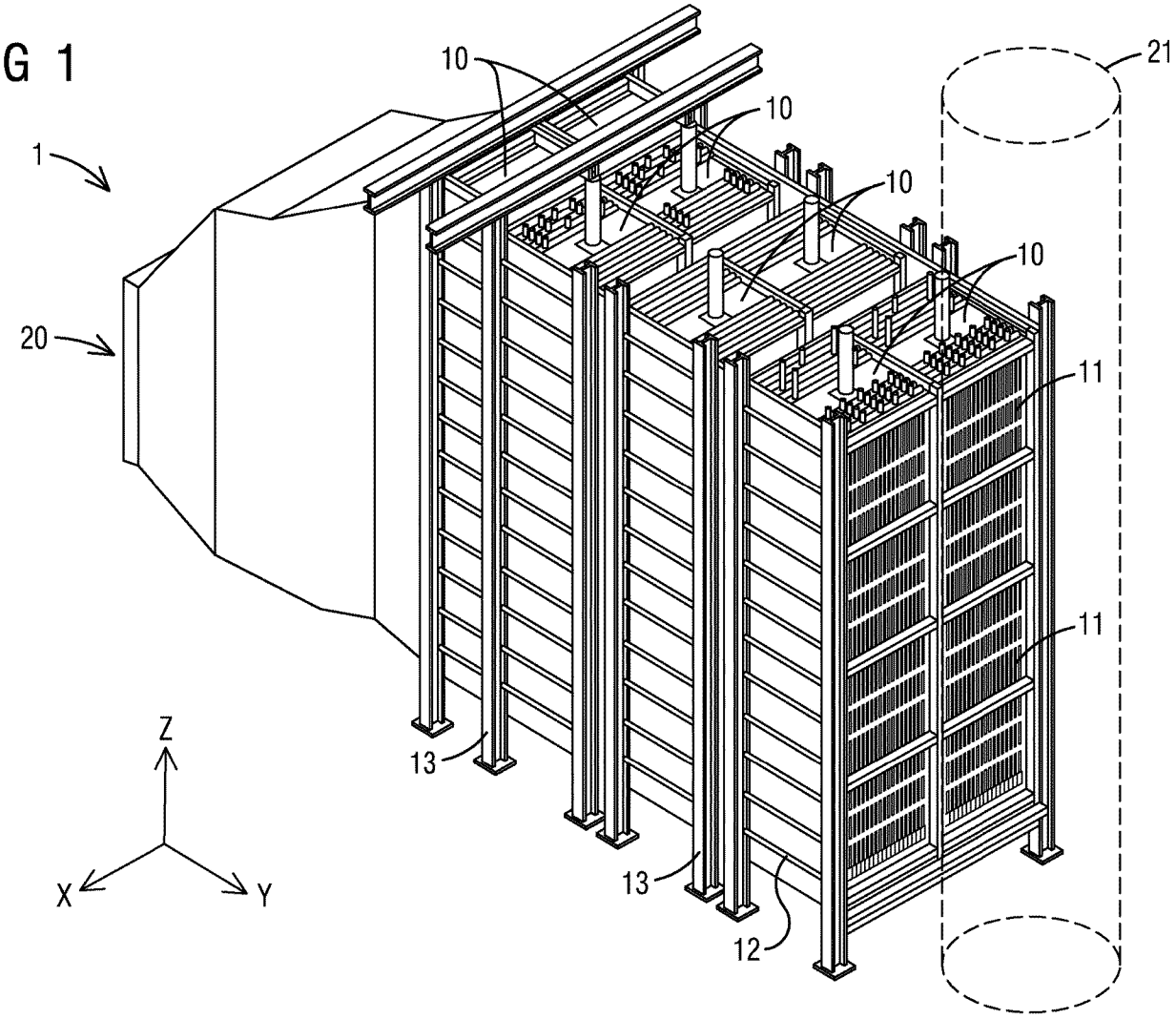
FIG. 1 illustrates a modular HRSG construction according to one embodiment.

In the drawings, the axes X and Y are arbitrarily chosen such that the X-Y plane is parallel to the plane of the horizontal. The axis Z is always assigned to the vertical direction, i.e. perpendicular to the X-Y plane.

In the illustrated embodiments, a "horizontal" direction or orientation may be understood to be any direction or orientation that is parallel to the plane of the horizontal, i.e., parallel to the X-Y plane. The terms "upward" and "downward" are defined with respect to the vertical direction which is parallel to the Z-axis.

FIG. 1 illustrates a modular heat recovery steam generator (HRSG) 1 comprising a plurality of modules 10 arranged adjacently in series. Each of the modules 10 includes a functional unit of the HRSG, such as an economizer (preheater), evaporator, reheater, or superheater. Essentially, each module 10 includes a heat exchanger comprising a plurality of heat exchanger tubes 11 which carry a fluid medium, such as water or steam or a mixture thereof, depending of the functionality of the respective module 10. The heat exchange tubes 11 are housed in a casing structure 12, which is supported by an exterior structural steel component 13, also referred to as main structural steel. Within the casing 12 is a conduit for the flow of hot gas, for example, from a combustion turbine exhaust. The exhaust gas enters the HRSG 1 via an inlet 20 and forms the heat source that convectively transfers heat to the medium in the heat exchange tubes 11. The casing structure 12 may have a layer of internal insulation 16, visible in FIG. 2, to reduce heat transfer to the exterior of the HRSG 1.

The illustrated embodiment shows a horizontal HRSG 1 in which the exhaust gas flows in through the modules 10 along a horizontal direction, in particular, parallel to the axis Y in FIG. 1. The heat exchange tubes 11 are disposed in the flow path of the exhaust gas and run in a vertical direction, parallel to the Z-axis in FIG. 1. In order to enhance the heat transfer area, the heat exchange tubes 11 may be firmed, i.e., the surface of the heat exchange tubes 11 may comprise external fins. A stack 21 is connected downstream of the modules 10 that forms an outlet port for the exhaust gas.

In a modular HRSG construction, the modules 10 including the various functional units of the HRSG, such as economizer, evaporator, reheater, and superheater, etc are prefabricated. The prefabrication takes place, for example, in a workshop or a manufacturing facility, where individual components of a functional unit are assembled to form a pre-assembled module. The pre-assembled module is then shipped, for example, in a transportation container, to an HRSG installation site, where the individual modules are installed such that the functional units are arranged in series, to construct a heat recovery steam generator as illustrated in FIG. 1.

A modular HRSG construction affords a number of benefits. For example, a modular construction provides increased standardization of the HRSG, thereby resulting in shorter delivery time. Also, a higher degree of prefabrication at the workshop results in reduced cost and effort at the installation site. Furthermore, a high level of quality may be achieved by prefabricating the modules at the workshop to the maximum extent possible. However, a high degree of prefabrication also increases the cost and complexity associated with shipping of the prefabricated parts.

The embodiments illustrated herein address at least the above issue and provides a solution which provides a high degree of pre-fabrication and lower shipping costs while also reducing the on-field installation cost and effort. Embodiments of the inventive concept may be directed to a method of pre-assembly of a module, a method for transporting a pre-assembled module to an installation site, and a method for installing a pre-assembled module at the installation site.

Figure 2:
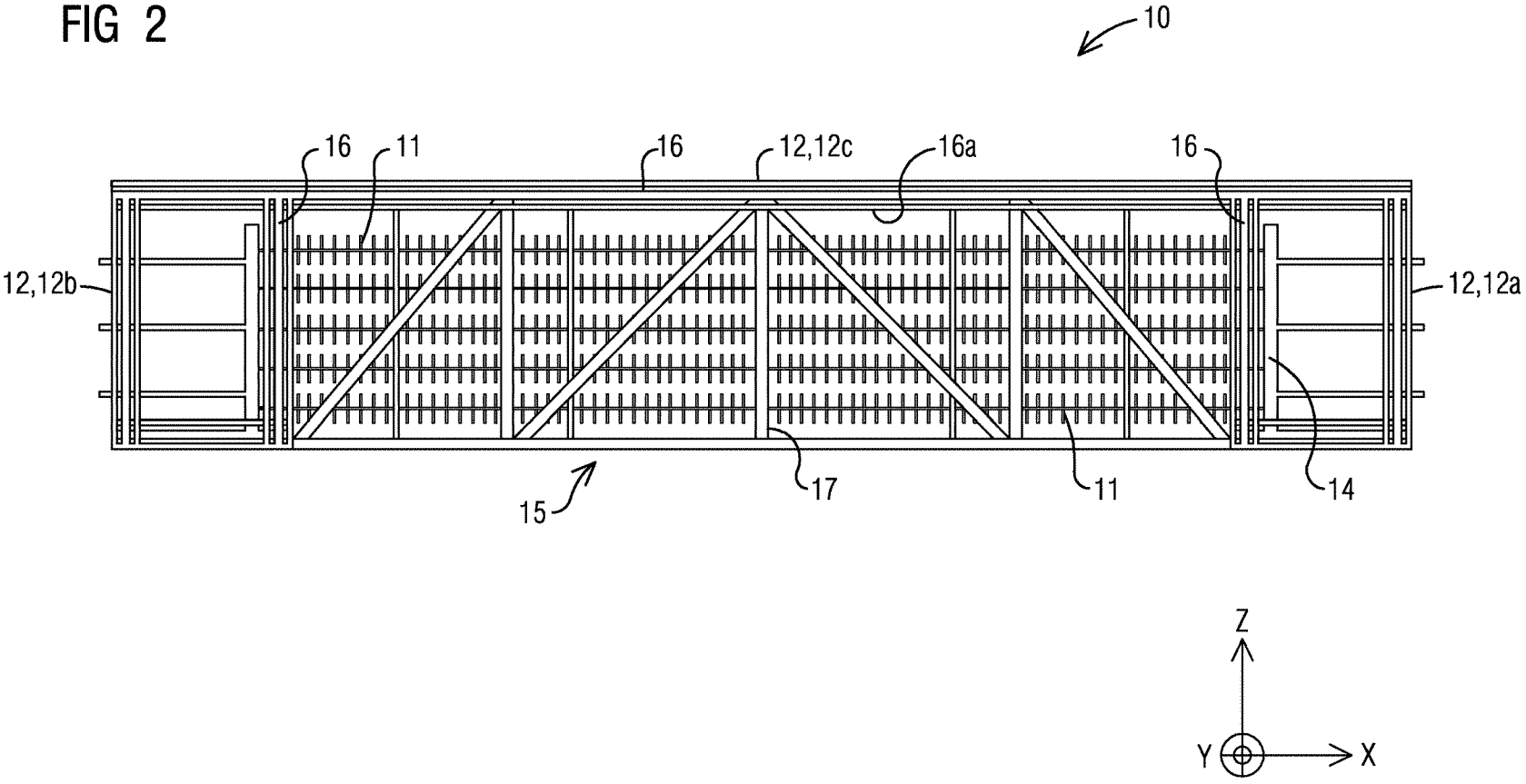
FIG. 2 illustrates a pre-assembled HRSG module according to one embodiment.

FIG. 2 illustrates an example embodiment of a module 10 of an HRSG. The module 10 is pre-assembled in a workshop or a manufacturing facility prior to being transported to the installation site. The pre-assembly includes building a functional unit of the HRSG, including arrangement of the heat exchange tubes 11, which in this embodiment comprise finned tubes. As a part of the functional unit, headers 14 may also be pre-assembled into the module 10 at the workshop or manufacturing facility.

The pre-assembly further includes building the casing structure 12 that houses the functional unit including, for example, the heat exchange tubes 11 and the headers 14. The casing structure 12 includes a top casing 12*a*, a bottom casing 12*b* and a side casing 12*c* connecting the top casing 12*a* and the bottom casing 12*b*. The side casing 12*c* is disposed to cover one of the sides of the module 10 but not on the other, whereby an open or uncovered side 15 is defined opposite to the side covered by the side casing 12*c*.

A layer of insulation 16, such as a ceramic insulation, may be disposed along the inner surface of the casing structure 12, including the top and bottom casings 12*a-b* and the side casing 12*c*. A liner 16*a* may be disposed to line the inner surface of the insulation 16. In one embodiment, for example if the module 10 includes an evaporator, a steam drum may be attached externally to the top casing 12*a* of the module at the pre-assembly stage.

The module 10 is built horizontally. That is to say, at the time of pre-assembly, the heat exchange tubes 11 are oriented in a horizontal direction, e.g. parallel to the plane of the workshop floor. In particular, the module 10 is built such that the open side 15 faces downward, i.e. facing the workshop floor, while the side casing 12 faces upwards. Reinforcement structure 17, such as a truss may be provided to support the module 10 during transportation. The module 10 is subsequently transported to the installation site in essentially the same position. In the illustrated embodiment, the pre-assembly does not include attachment of the main structural steel 13 to the module 10, which is done at the installation site.

It is to be noted that at the time of on-field installation, the module 10 is rotated by 90 degrees such that the heat exchange tubes 11 run along a vertical direction, whereby the top casing 12*a* would face upward and the bottom casing 12*b* would face downward.

Figure 3:
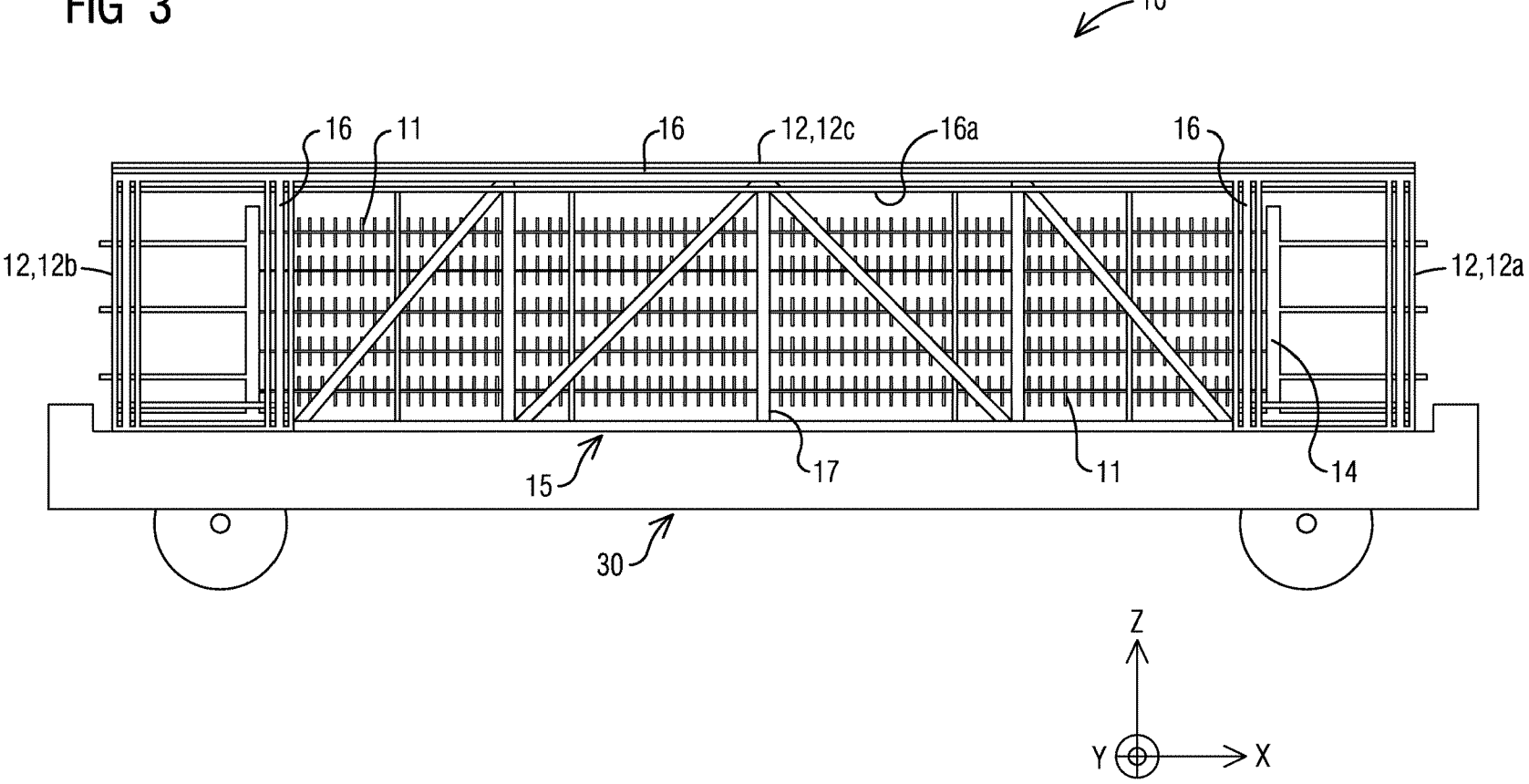
FIG. 3 is a schematic illustration depicting the transportation of a pre-assembled HRSG module according to an exemplary embodiment.

FIG. 3 schematically illustrates the transportation of a pre-assembled module 10 according to one embodiment. The method includes loading the pre-assembled module 10 from the pre-assembly site into a transportation container 30. The pre-assembled module is loaded in a horizontal position in the container 30, such that the heat exchanger tubes 11 are oriented horizontally, with the open side 15 facing vertically downward and the side casing 12*c* facing vertically upward. The container 30 with the loaded pre-assembled module 10 is transported to the installation site, for example, by rail, or road, or water, or combinations thereof.

The present method provides several technical benefits not perceived in the previously used methods in which the module was prefabricated and transported with the open side facing upward and the side casing facing downward. In the present method, by transporting the pre-assembled module with the open side 15 facing downward and the side casing facing upward 12*c*, it is ensured that the center of gravity of the module 10 is significantly reduced. This is because the heat exchange tubes 11, which form the bulk of the weight of the module 10, now occupy a bottom portion of the module 10, while the much lighter side casing 12*c* with the insulation 16 occupy a top portion of the module 10. A lower center of gravity aids ease of shipping while reducing safety hazards during transportation of the module 10. Furthermore, in the illustrated method, shipping dimensions are smaller than with a pre-assembled module with main structural steel attached.

At the installation site, the module 10 is unloaded from the container 30 and disposed essentially in the same position as it was transported, i.e., in a horizontal orientation, with the open side 15 facing downward and the side casing 12*c* facing upward.

Figure 4:
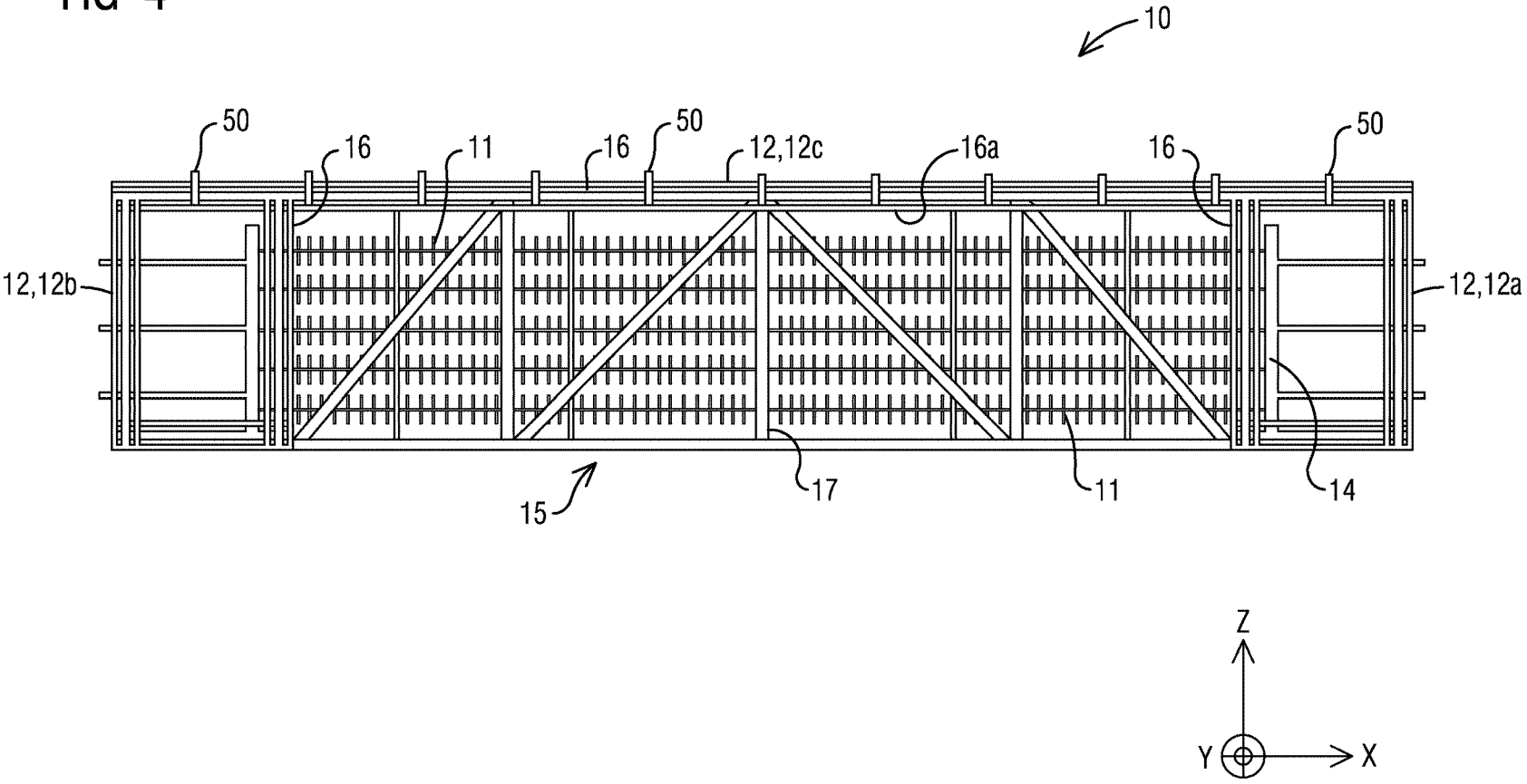
FIG. 4, FIG. 5 and FIG. 6 illustrate a sequence of steps in an on-field installation of a pre-assembled HRSG module according to an exemplary embodiment.
Figure 5:
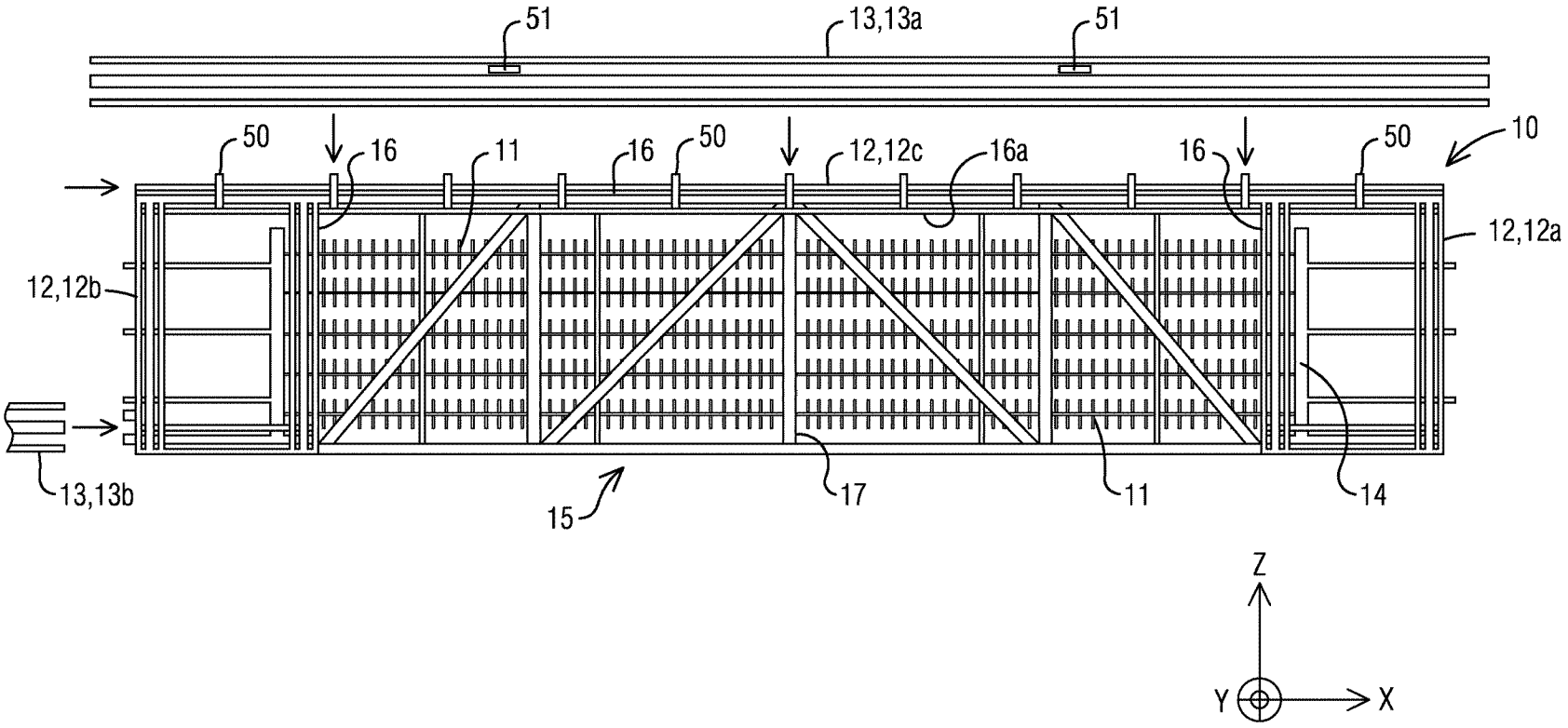
Figure 6:
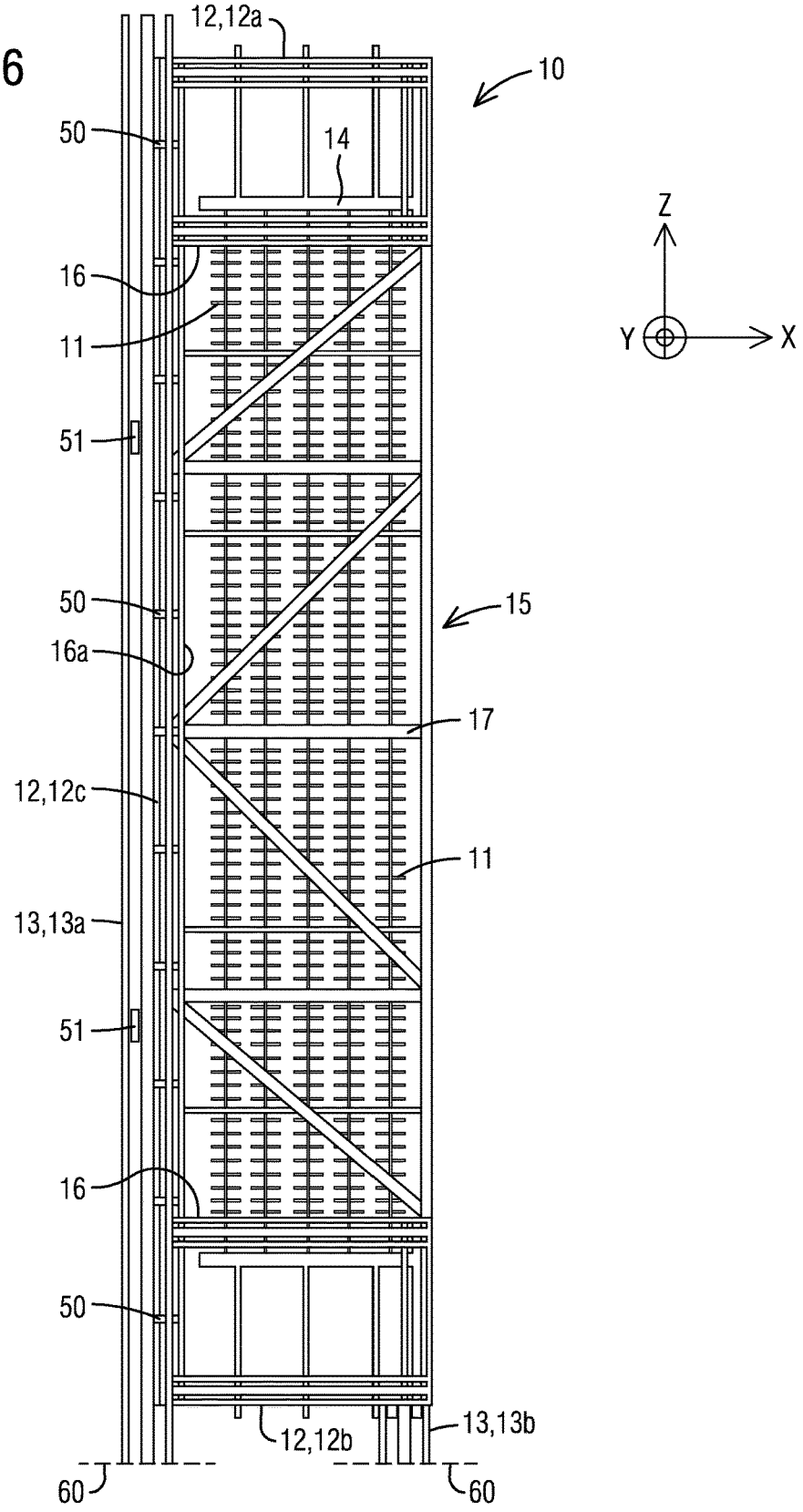

FIG. 4-6 illustrate exemplary steps involved in installation of the pre-assembled module 10 at the installation site. Referring to FIG. 4, the pre-assembled module 10 is initially arranged at the installation site in a horizontal position, i.e., with the heat exchanger tubes oriented parallel to the X-Y plane, with the open 15 facing vertically downward (i.e., facing the ground) and the side casing 12*c* facing upward.

Subsequently, as illustrated in FIG. 5, the main structural steel 13 maneuvered towards the module 10, for attachment to the casing 12. In the illustrated embodiment, the main structural steel 13 comprises a side structural steel component 13*a* that is to be attached to the side casing 12*c* and a bottom structural steel component 13*b* that is to be attached to the bottom casing 12*b*. The present method makes it possible to attach the structural steel 13 to module 10 in a horizontal position, without having to lift the module 10. The side structural steel component 13*a* is an elongated steel column and may be attached in a horizontal position (i.e., parallel to the X-Y plane) to the upward facing side casing 12*c*, for example, by bolted connections 50 provided at various points along the length of the side casing 12*c*. Alternately or additionally, the side structural steel component 13*a* may be welded to the side casing 12*c* at one or more points. The bottom structural steel component 13*b* may be affixed to the bottom casing 12*b*, for example by bolting, welding, or any other means.

In a subsequent step, as illustrated in FIG. 6, the module 10 with the attached structural steel 13 components 13*a*, 13*b* is lifted up to a vertical position, i.e., rotated by 90 degrees such that the module/structural steel assembly is now parallel to the Z-axis. In order to aid lifting of the module/structural steel assembly, slotted holes 51 may be provided on the side structural steel 13*a*. The module 10 is then secured to a foundation 60 via the structural steel components 13*a*, 13*b* to finally erect the module 10 at the installation site. As illustrated in FIG. 1, a plurality of pre-assembled modules 10 may be erected in a similar manner and stacked in series adjacent to each other such that the casings 13 of the respective module form a common gas tight housing of the HRSG that encloses the functional units therein. Inside the casings 13 is defined a horizontal flow path for exhaust gas. The heat exchange tubes 11 of the modules 10 are disposed in said flow path and run in a vertical direction.

The installation method illustrated in FIG. 4-6 provides several benefits over existing installation techniques. As per the existing installation technique, the module was arranged at the installation site with its open side facing upward and the side casing facing downward. In this case, the main structural steel was first lifted in a vertical position and guy-wired, which obstructed accessibility and posed a potential safety hazard. Further, since the module was disposed with the side casing facing the ground, it was not possible to access the side casing to attach the structural steel in a horizontal position. The module had to be lifted to a vertical position and then connected to the vertically arranged structural steel, typically by bolting or welding to the side casing at different elevations. Since the structural steels, particularly the side structural steel components are elongated columns, often extending about 90 ft in height, working at elevations on a vertically oriented structural steel components posed potential safety hazards.

In contrast, as per the proposed method, arranging the pre-assembled module at the installation site with the open side facing downward and the side casing facing upward makes it possible to attach the structural steel to the side casing while the module is still horizontal, without having to lift the module. This approach reduces the installation efforts and costs as the structural steel is much lighter than the pre-assembled module and is much easier to maneuver. Furthermore, this feature improves the safety of the installation by eliminating the need to work at elevation to connect the module to the structural steel.

In summary, the present technique exemplified by the illustrated embodiments provide improved safety and ease of construction while significantly reducing total installed cost by providing particularly reduced shipping cost and on-field installation effort. For example, it has been seen that in a combined cycle installation involving two modular HRSG constructions involving 10-12 modules each, a saving of $600,000-$800,000 may be achieved on the total installed cost (including prefabrication cost, shipping cost and on-field installation cost) by employing the present technique over the existing ones.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A method for installing a heat recovery steam generator comprising a plurality of pre-assembled modules at an installation site, the method comprising:

arranging a pre-assembled module of the heat recovery steam generator at an installation site, wherein the pre-assembled module comprises a functional unit of the heat recovery steam generator housed in a casing structure, the casing structure comprising a top casing, a bottom casing and a side casing, whereby an open side is defined opposite to the side casing, wherein the pre-assembled module is arranged in a horizontal position on the installation site with the open side facing downward and the side casing facing upward, attaching an exterior structural steel component to the side casing in a horizontal position without lifting the module, lifting the module with the attached exterior structural steel component to a vertical position, and securing the exterior structural steel component to a foundation with the module in the vertical position.

2. The method according to claim 1, further comprising transporting the pre-assembled module to the installation site with the open side facing downward and the side casing facing upward.

3. The method according to claim 1, wherein said lifting is carried out by way of slotted holes provided on the exterior structural steel component.

4. The method according to claim 1, wherein said attaching comprises bolting the exterior structural steel component to the side casing in the horizontal position.

5. The method according to claim 1, wherein the functional unit of the pre-assembled module comprises a plurality of heat exchange tubes configured for conducting a fluid medium.

6. The method according to claim 5, wherein in the installed position, the heat exchanger tubes are oriented vertically.

7. The method according to claim 5, wherein the heat exchange tubes comprise finned tubes.

8. The method according to claim 1, wherein the functional unit is selected from the group consisting of: economizer, evaporator, superheater and reheater.

9. The method according to claim 1, wherein the pre-assembled module further comprises a feeder header.

10. The method according to claim 1, wherein the pre-assembled module further comprises a steam drum attached externally to the top casing.

11. The method according to claim 1, wherein the pre-assembled module further comprises a layer of insulation along an inner surface of the casing structure.

* * * * *